US006244971B1

(12) United States Patent
Mihran

(10) Patent No.: US 6,244,971 B1
(45) Date of Patent: Jun. 12, 2001

(54) SPIN DETERMINATION FOR A ROTATING OBJECT

(75) Inventor: Richard T. Mihran, Longmont, CO (US)

(73) Assignee: The DistanceCaddy Company, LLC, Fort Collins, CO (US)

( * ) Notice: Subject to any disclaimer, the term of this patent is extended or adjusted under 35 U.S.C. 154(b) by 0 days.

(21) Appl. No.: 09/314,877

(22) Filed: May 19, 1999

Related U.S. Application Data

(60) Provisional application No. 60/117,527, filed on Jan. 28, 1999.

(51) Int. Cl.[7] ..... A63B 57/00

(52) U.S. Cl. ..... 473/200; 473/353; 473/378

(58) Field of Search ..... 473/150–156, 473/198–200, 351, 353, 378, 385, 407

(56) References Cited

U.S. PATENT DOCUMENTS

| | | | | |
|---|---|---|---|---|
| 3,438,031 | | 4/1969 | Fathauer | 343/8 |
| 3,508,440 | | 4/1970 | Murphy | 73/379 |
| 3,837,655 | | 9/1974 | Angelos | 273/185 |
| 3,938,809 | | 2/1976 | Gentiluomo | 273/176 |
| 4,137,566 | | 1/1979 | Haas et al. | 364/410 |
| 4,276,548 | | 6/1981 | Lutz | 343/7 |
| 4,545,576 | | 10/1985 | Harris | 273/25 |
| 4,673,183 | | 6/1987 | Trahan | 273/176 |
| 4,858,922 | | 8/1989 | Santavaci | 273/26 |
| 5,082,263 | * | 1/1992 | Berger | 273/29 R |
| 5,092,602 | | 3/1992 | Witler et al. | 273/184 |
| 5,150,895 | | 9/1992 | Berger | 273/29 |
| 5,246,232 | | 9/1993 | Eccher et al. | 273/184 |
| 5,333,874 | * | 8/1994 | Arnold et al. | 273/185 B |
| 5,354,063 | * | 10/1994 | Curchod | 273/185 B |
| 5,401,026 | | 3/1995 | Eccher et al. | 273/184 |
| 5,437,457 | * | 8/1995 | Curchod | 273/185 A |
| 5,481,355 | | 1/1996 | Iijima et al. | 356/28 |
| 5,700,204 | * | 12/1997 | Teder | 473/199 |
| 5,863,255 | * | 1/1999 | Mack | 473/152 |
| 5,984,794 | * | 11/1999 | Miremadi | 473/199 |
| 6,148,271 | * | 11/2000 | Marinelli | 702/141 |

OTHER PUBLICATIONS

"DistanceCaddy" advertising brochure distributed by Colorado Time Systems.

* cited by examiner

*Primary Examiner*—Joe H. Cheng
*Assistant Examiner*—Julie Kasick
(74) *Attorney, Agent, or Firm*—Marsh Fischmann & Breyfogle LLP

(57) ABSTRACT

An apparatus for use in determining spin characteristics of an appropriately configured rotating object, such as a golf ball, includes a transmitter, a receiver, and a demodulator. The object is configured for reflecting radiation of at least a first frequency in a modulated fashion corresponding to at least one spin characteristic of the object. In this regard, an appropriately configured object may include at least one contrast area comprised of a material having different reflectivity than the rest of the object to electromagnetic radiation of at least the first frequency. The transmitter is positioned for transmitting electromagnetic radiation of at least the first frequency at the object. The receiver is positioned for receiving at least a portion of the modulated reflected radiation. The transmitter and receiver may comprise a single transceiver unit. The demodulator detects the modulated nature of the reflected radiation received by the receiver and outputs a demodulated signal including information about at least one spin characteristic of the object.

40 Claims, 7 Drawing Sheets

SPIN DETERMINATION FOR A ROTATING OBJECT

RELATED APPLICATION INFORMATION

This application claims priority from co-pending provisional application Ser. No. 60/117,527, filed on Jan. 28, 1999.

FIELD OF THE INVENTION

The present invention relates to determining of the spin characteristics of a rotating object. More particularly, the present invention relates to the determination of the rate of spin and the axis of rotation of a rotating object, such as, for example, a golf ball that has been struck with a golf club.

BACKGROUND OF THE INVENTION

In many applications it is desirable to determine the spin characteristics of a rotating object, including the object's total rate of spin (spin rate) and the axis about which the object is rotating (spin axis). For example, the spin characteristics of a golf ball in conjunction with other parameters such as ball velocity and launch angle may be used to accurately predict the trajectory followed by the golf ball after it as been struck with a golf club. Such information is useful in golf simulator applications as well as golf equipment research and development applications. The determination of spin characteristics is also useful in assessing the effects of changes in a golfer's technique or equipment on the spin characteristics of a struck golf ball as part of a training system or an equipment selection system.

Devices and methods that attempt to characterize the spin of a rotating object, such as a golf ball, are known. With some devices and methods, spin information is inferred from observations of the rebound path followed by the ball after striking a mechanical network or grid having known characteristics. In other devices and methods, permanent magnets are embedded in the ball resulting in rotating magnetic fields as the ball spins. The rotating magnetic fields may be detected by coils placed in close proximity to where the ball is struck. Other devices and methods utilize high-speed photographic or videographic techniques. Sequential images of a ball having markings on its surface are obtained. By analyzing the relative position of the markings in the sequential images either manually or with computer processing means, the spin characteristics of the ball over the time interval of the images may be obtained.

The approaches to determining the spin characteristics outlined above can present several disadvantages, particularly when utilized in golf simulation, training, equipment selection, or general research and development applications. Mechanical grids can be relatively bulky and may provide inconsistent results when different types of balls and/or ball cover compositions are used. Also, mechanical grids interrupt the flight path of the ball preventing a user from observing the actual flight path of the ball. Magnetic systems require specially manufactured balls with magnets embedded therein. The magnets can change the moment of inertia of the ball thereby reducing the suitability of such devices and methods in research and development or equipment selection applications. High-speed photographic and videographic techniques systems are typically complex and expensive. Furthermore, such systems require a high resolution image and therefore highly magnified view of the ball resulting in a spin determination over only a very limited portion of the flight path of the ball. Additionally the performance of such systems may be compromised in outdoor situations where bright sunlight can interfere with image quality.

The devices and methods outlined above also share the common disadvantage that the spin characteristics of the ball are typically measured or sampled over only a relatively short interval of time immediately after the ball is struck. However, due to drag forces, the spin rate of the ball decays over its flight path. Particularly in research and development applications where it may be desirable to characterize the aerodynamic properties of a particular ball design, the capability of monitoring the spin characteristics over a longer portion of the ball's flight path may be advantageous.

SUMMARY OF THE INVENTION

In view of the forgoing, one objective of the present invention is to provide for the efficient and accurate determination of the spin rate of a rotating object, such as a golf ball.

Another objective of the present invention is to provide for the efficient and accurate determination of the spin axis of a rotating object, such as a golf ball.

An additional objective of the present invention is to provide for the determination of the spin characteristics of a moving, rotating object such as a golf ball without interrupting its flight path.

A further objective of the present invention is to provide for the determination of the spin characteristics of a moving, rotating object such as a golf ball over selected portions of its flight path.

Yet another object of the present invention is to provide for the determination of the spin characteristics of a moving, rotating object such as a golf ball without substantially effecting the object's moment of inertia.

These and other objectives and advantages are achieved by various aspects of the present invention. According to one aspect of the present invention, an apparatus for use in determining spin characteristics of a rotating object includes a transmitter, a receiver, and a demodulator. The transmitter is positioned for transmitting electromagnetic radiation of at least a first frequency at the object. The object is appropriately configured for reflecting at least a portion of the radiation transmitted thereat such that the amplitude, frequency or phase of radiation reflected by the object is modulated in a manner corresponding to at least one spin characteristic of the object. In this regard, the object may, for example, be a golf ball including at least one contrast area having different reflectivity to the transmitted radiation than the rest of the ball so that as the ball spins, the reflected radiation is amplitude modulated. The receiver is positioned for receiving at least a portion of the modulated reflected radiation. The transmitter and receiver may comprise a single transceiver unit. The demodulator is coupled to the receiver for detecting the modulated nature of the reflected radiation received by the receiver and outputting a demodulated signal including information about at least one spin characteristic of the object.

According to another aspect of the present invention, an apparatus for use in determining spin characteristics of a golf ball moving over an expected flight path includes a transceiver, a pre-amplifier/filter, a demodulator and a comparator. The transceiver is positioned for transmitting electromagnetic radiation of at least a first frequency into the expected flight path of the ball. The ball is appropriately configured for reflecting at least a portion of the transmitted radiation in a modulated fashion corresponding to at least one spin characteristic of the ball. A portion of the reflected radiation is receivable by the transceiver and mixed therein with a signal at the same frequency as the transmitted radiation to generate a difference signal. The difference signal is correspondingly modulated with the reflected radiation. The pre-amplifier/filter amplifies and filters the difference signal. The demodulator detects the modulation characteristics of the amplified and filtered difference signal and outputs a demodulated analog signal corresponding to the modulated difference signal. The demodulated analog signal includes information about at least one spin characteristic of the object. The comparator converts the demodulated analog signal to a digital signal that includes information about at least one spin characteristic of the object.

According to a further aspect of the present invention, a ball adapted for determination of its spin characteristics includes at least one contrast area. The contrast area is comprised of a material having different reflectivity than the rest of the ball to electromagnetic radiation of a predetermined frequency. In this regard, the predetermined frequency to which the contrast area has different reflectivity is preferably in the Radar frequency or the near infra-red frequency ranges. More preferably, the predetermined frequency is in the X, K, or Ka bands. The contrast area is configured such that as the ball spins, radiation of the predetermined frequency reflected off the ball is modulated in a manner such that at least one spin characteristic of the ball may be determined therefrom. In this regard, the ball may have one, generally rectangular contrast area having greater reflectivity to radiation of the predetermined frequency. As the ball spins, the contrast area causes the reflected radiation to have periodic amplitude peaks occurring at a frequency corresponding to the spin rate of the ball. The ball may also include two contrast areas of higher reflectivity appropriately configured for causing the reflected signal to have periodic pairs of amplitude peaks. In this regard, the pairs of amplitude peaks occur at a frequency corresponding to the spin rate of the ball. Further, the two contrast areas may be arranged in a divergent, non-parallel fashion such that as the spin axis of the ball varies, the interval between pairs of amplitude peaks varies in a known manner that is correlated with the spin axis based upon the geometry of the contrast areas. This permits determination of the spin axis. The ball may also have three contrast areas of higher reflectivity causing the reflected radiation to have groups of three amplitude peaks occurring at a frequency corresponding to the spin rate of the ball. The three contrast areas may be arranged in an appropriate manner, such as, for example, resembling the letter "Z", so that the ratio of the interval between the first and second amplitude peaks in a group to the interval between the second and third amplitude peaks in the same group varies in a known manner as the spin axis of the ball varies, thereby permitting determination of the spin axis therefrom.

According to an additional aspect of the present invention, a method of determining spin characteristics of a rotating object includes providing an object including at least one contrast area having different reflectivity than the rest of the object to electromagnetic radiation of a predetermined frequency. In this regard, the contrast area may be a marking applied on the outside surface of the object. Electromagnetic radiation of the predetermined frequency is transmitted in the direction of the object. A portion of the transmitted radiation is reflected from the object and amplitude modulated in a manner corresponding to at least one spin characteristic of the object as a result of the contrast area periodically facing the source of the transmitted radiation as the object rotates. A portion of the amplitude modulated reflected radiation is received. The received reflected radiation is demodulated to generate a demodulated signal including information corresponding to at least one spin characteristic of the object. In one embodiment of the method, the demodulated signal may include periodic pulses, with the spin rate of the object being determinable from the frequency of the pulses. In another embodiment, the demodulated signal may include periodic pairs of pulses, with the spin rate of the object being determinable from the frequency of the pairs of pulses and the spin axis of the object being determinable from the relative interval between sequential pairs of pulses. In a further embodiment, the demodulated signal may include periodic groups of three pulses, with the spin rate of the object being determinable from the frequency of the groups of three pulses and the spin axis of the object being determinable from the ratio of the interval between the first and second pulses of a group to the interval between the second and third pulses of the same group.

These and other features and advantages of the present invention will be apparent upon a review of the following detailed description when taken in conjunction with the accompanying figures.

DETAILED DESCRIPTION

Figure 1:
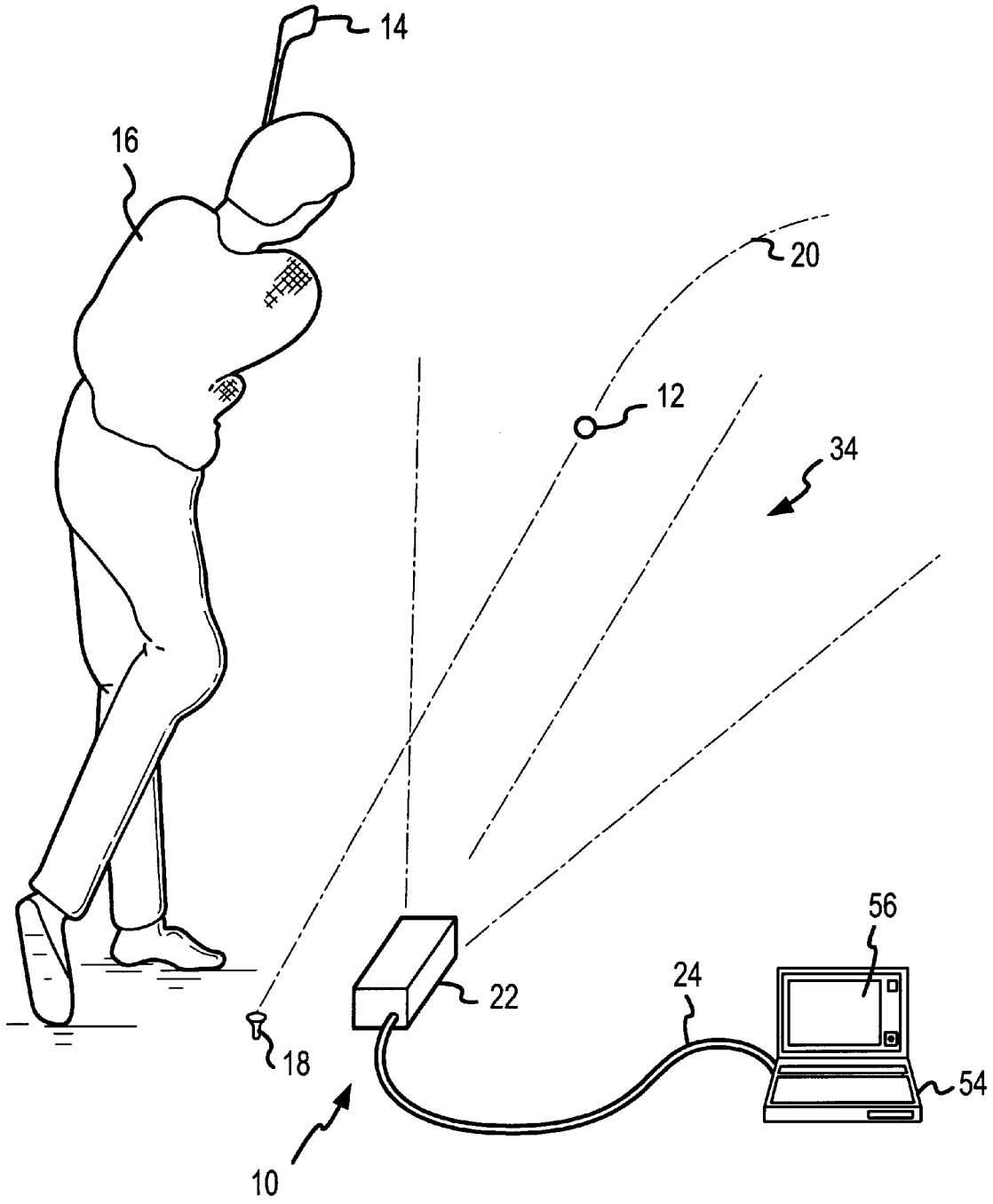
FIG. 1 illustrates one embodiment of an apparatus in accordance with the present invention shown being used to determine the spin characteristics of golf ball after it has been struck by a golfer.

In FIG. 1, one embodiment of an apparatus 10 of the present invention is shown being used for determining the spin characteristics of a golf ball 12 after it has been struck by a golf club 14 swung by a golfer 16. The golf ball 12 is shown after being hit off of a starting point, such as a tee 18, and is in flight on a flight path represented by the dot-dashed line 20. While the apparatus 10 is illustrated in connection with a golf ball 12, it should be appreciated that the apparatus 10 of the present invention may be utilized for determining the spin characteristics of other rotating objects as well, such as, for example, a baseball.

Figure 2:
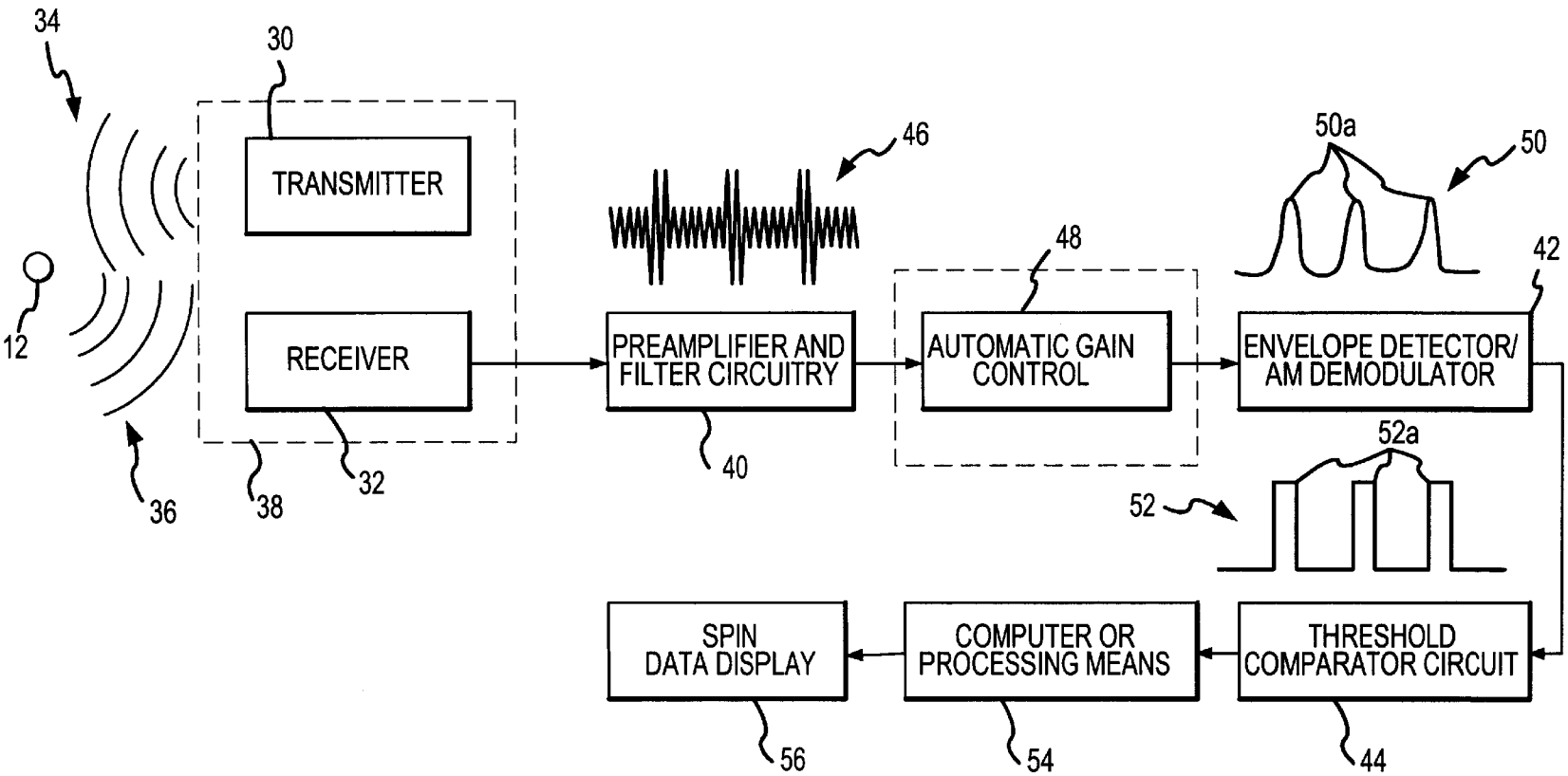
FIG. 2 is a block diagram of an apparatus in accordance with the present invention.

In FIG. 2, a block diagram of the apparatus 10 is illustrated. The apparatus 10 includes a transmitter 30 and a receiver 32. The transmitter 30 transmits electromagnetic radiation 34 of a suitable frequency in the direction the ball 12. As is illustrated in FIG. 1, the apparatus 10 may be positioned proximate to the tee 18 (e.g. directly behind, in front, or along side as is illustrated) so that the transmitted radiation 34 from the transmitter 30 intersects the flight path 20 of the ball 12 near the tee 18 in order to determine the spin characteristics of the ball 12 during the initial portion of its flight path 20. To deter mine the spin characteristics of the ball 12 during later portions of its flight path 20, the apparatus 10 may be placed downrange along the expected flight path 20 of the ball 12. A portion of the transmitted radiation 34 is reflected by the ball 12 resulting in reflected radiation 36. A portion of the reflected radiation 36 is received by the receiver 32.

The transmitter 30 and receiver 32 may together comprise a single transceiver unit 38, such as a conventional speed measuring device used in law-enforcement applications or a motion sensing device used in security and door-opener applications. Such appropriate devices typically employ a Gunn diode and a mixer diode in a suitable resonant cavity coupled into a radiating horn, and commonly transmit at frequencies in the range of 10 to 30 Ghz. In this regard, the transceiver may transmit radiation 34 in the RADAR frequency range, such as in the X, K, or Ka bands. Other frequencies may also be used, and further, the transceiver 38 may comprise a LIDAR unit operating in the near infra-red range.

Because the ball 12 is moving relative to the stationary transceiver 38, the component of velocity of the ball 12 along the line of sight to the transceiver 38 results in a Doppler shift in the reflected radiation 36. As is well known by those skilled in the art, the portion of the reflected radiation 36 received may be mixed in the transceiver 38 with a portion of the transmitted radiation 34 producing a difference signal. Such difference signal has a center frequency corresponding to the velocity of the ball 12. For example, if the transmitted radiation 34 is in the K-band, the velocity V (in miles per hour) of the ball 12 is related to the frequency f (in Hz) of the difference signal in accordance with the following relation:

$$V=f/72$$

With typical ball 12 speeds, the frequency of the difference signal is typically in the audio range. Thus, the difference signal may be amplified and processed with well known components.

When the ball 12 is appropriately configured, such as described below in reference to FIGS. 3–8, in addition to being Doppler-shifted, the reflected radiation 36 will also be amplitude modulated, and the difference signal that results from mixing a portion of the transmitted radiation 34 with the received reflected radiation 36 will also exhibit amplitude modulation (i.e. the amplitude of the signal changes periodically). Thus, it will be appreciated that the resulting difference signal may be seen as a conventional amplitude modulated carrier signal. The frequency of the carrier signal provides information about the velocity of the ball 12, and as will be described in more detail below, the amplitude modulated characteristics of the difference signal may be utilized to determine the spin characteristics of the ball 12.

Conventional means may be employed to amplify and detect the modulation characteristics of the difference signal. In this regard, the apparatus 10 may further include pre-amplifier/filter circuitry 40, AM demodulator circuitry 42 and comparator circuitry 44.

The pre-amplifier/filter 40 amplifies and filters the difference signal output by the transceiver 38. A typical amplified and filtered difference signal 46 is shown in FIG. 2 above the block representing the pre-amplifier/filter 40. While conventional operational amplifier and filter circuits may be employed, care should be taken to ensure that the overall gain of the pre-amplifier/filter 40 is chosen to avoid the occurrence of clipping or amplifier saturation in order to preserve the full dynamic range of the modulated difference signal output by the transceiver 38. Though not necessary to practice the invention, automatic gain control (AGC) circuitry 48 may be included in the apparatus 10 in order to better preserve the full dynamic range of the modulated difference signal under a wider variety of hitting conditions (e.g. backspin, sidespin, or topspin of varying speeds) than with a preset gain. The pre-amplifier/filter 40 preferably performs both low-pass and high-pass filtering to reduce low-level baseline drift and high frequency noise. Where the transmitted radiation 34 is in the K-band, low and high cut-off frequencies of 1000 Hz and 20 KHz, respectively, have been found to be appropriate.

The AM demodulator 42 receives the amplified and filtered difference signal 46 and demodulates the signal 46. The AM demodulator preferably employs conventional envelope detection circuitry well known in the art. The envelope detection circuitry of the AM demodulator 42 outputs an analog signal, such as the typical analog signal 50 depicted in FIG. 2 above the block representing the AM demodulator 42, having a series of peaks 50*a*. As will be explained further below, the frequency of these peaks 50*a* corresponds to the spin rate of the ball 12.

The comparator 44 converts the analog signal 50 output by the AM demodulator 42 to a digital signal 52 comprised of a series of digital pulses 52*a* corresponding to the peaks 50*a* of the analog signal 50. A typical digital signal 52 output by the comparator 44 is shown in FIG. 2 above the block representing the comparator 44.

The digital signal 52 output from the comparator 44 may be fed to a computer or other processing means 54 for determination of the spin characteristics of the ball 12 using the digital signal 52. The computer 54 outputs the determined spin characteristics of the ball 12 on a display device 56. The computer 54 and display 56 may be integrated in one unit with the other components of the apparatus 10, or, as is preferred, the computer 54 and display 56 may be an appropriately programmed stand-alone computer and monitor (e.g. a desktop or laptop computer) to which the apparatus 10 is connectable, via, for example, a serial interface. Such a set-up is depicted in FIG. 1 wherein the transceiver 38, pre-amplifier/filter 40, AGC circuitry 48, AM demodulator, and comparator 44 are contained within a housing 22 connected via a cable 24 with a laptop computer 54 having an integrated display 56.

While the apparatus 10 of the present invention may function as a device only for determining the spin characteristics of a rotating object, such as a golf ball, it should be appreciated that the apparatus 10 of the present invention may be part of a device that performs additional functions as well. Such additional functions may include the determination of the velocity of a struck golf ball 12 via the Doppler-shift effect as summarized above.

Figure 3:
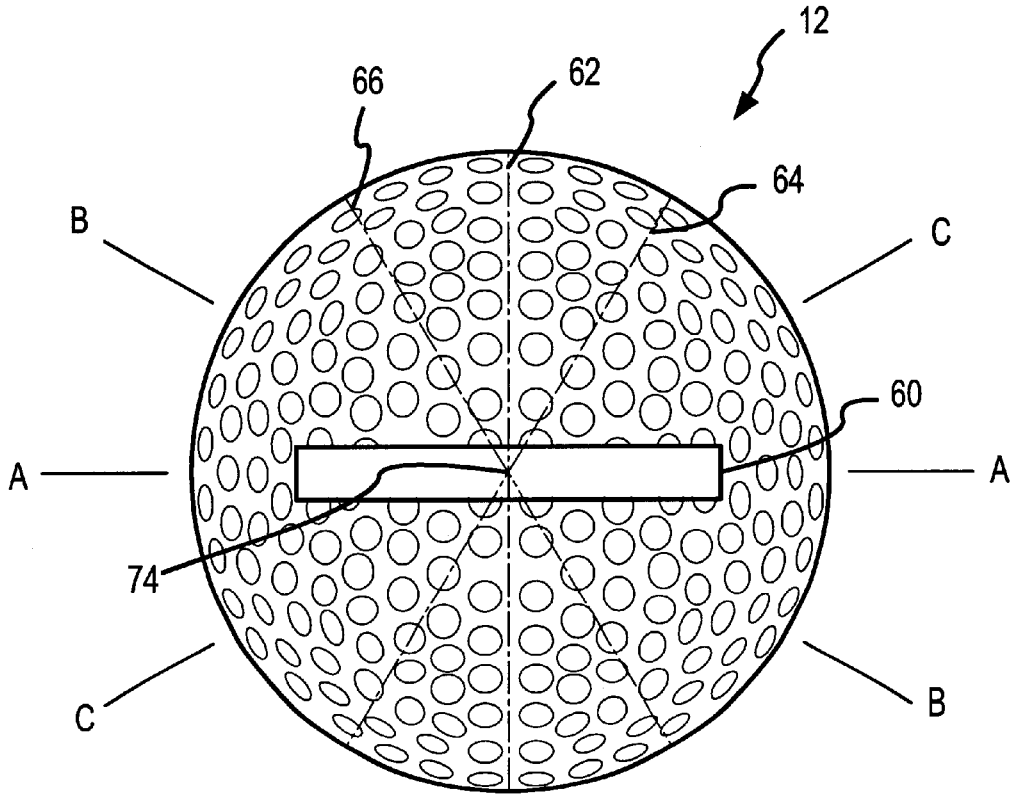
FIG. 3 illustrates one embodiment of a golf ball adapted for spin rate determination in accordance with the present invention.

Referring now to FIG. 3, one embodiment of a golf ball 12 adapted for spin rate determination using an apparatus 10 in accordance with the present invention is shown. The ball 12 includes a contrast area 60, which, in this instance, is on the surface of the ball 12. Though the contrast area 60 may be differently shaped, it is preferably generally rectangularly shaped. Further, for transmitted radiation 34 in the K-band, the contrast area 60 is preferably about 0.75 inches by 0.25 inches. The contrast area 60 is comprised of a material having sufficiently distinct dielectric properties from that of the normal surface of the ball 12 such that the contrast area 60 provides a region of the ball 12 having different, and preferably higher, reflectivity to the transmitted radiation 34. Such materials include, for example, metal films and foils such as adhesive-backed copper foil tape, conductive inks and paints such as those employed in the fabrication of flexible electronic circuit assemblies, and optically reflective tapes and paints such as those commonly used to provide reflective markings on road signs, vehicles, bicycle components, clothing and the like. Conductive inks and paints are particularly appropriate due to the relative ease with which they may be applied using mass-production techniques.

When the ball 12 is struck by a golf club 14 and enters the portion of its flight path 20 intersected by the transmitted radiation 34, a portion of the transmitted radiation 34 is reflected therefrom. When the ball 12 spins, the contrast area 60 comes into direct view of the transceiver 38 once each revolution. For example, three possible spin conditions are represented in FIG. 3 wherein the ball 12 revolves about axes A—A, B—B, or C—C. In the case of axis A—A, a point 74 on the surface of the ball 12 traces a circumferential path represented by dotted line 62 as the ball 12 revolves about axis A—A. In the case of axis B—B, the point 74 traces a path represented by dotted line 64 as the ball 12 revolves about axis B—B. In the case of axis C—C, the point 74 traces a path represented by dotted line 64 as the ball 12 revolves about axis C—C. In order to enhance the likelihood that the contrast area 60 comes into direct view of the transceiver 38 once each revolution, the ball 12 is preferably placed on the tee 18 (or the ground if no tee is used) such that the contrast area 60 faces away from the point of expected impact with the golf club 14 with the long dimension of the contrast area 60 substantially parallel with the ground.

Figure 4A:
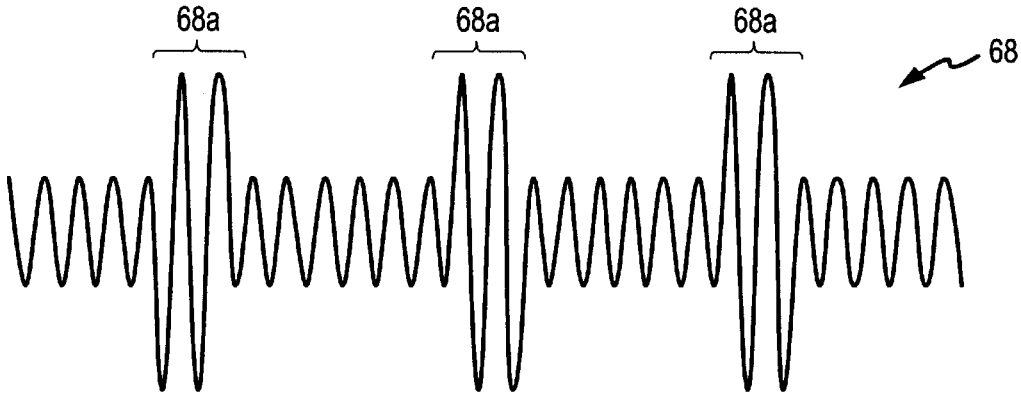
FIG. 4*a* illustrates an exemplary difference signal obtained from radiation reflected off a rotating golf ball such as the ball depicted in FIG. 3.
Figure 4B:
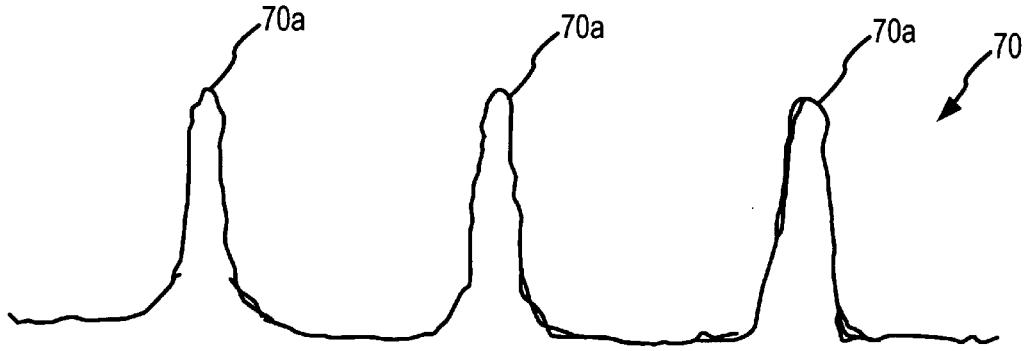
FIG. 4*b* illustrates an exemplary demodulated analog signal corresponding to the difference signal of FIG. 4*a;*
Figure 4C:
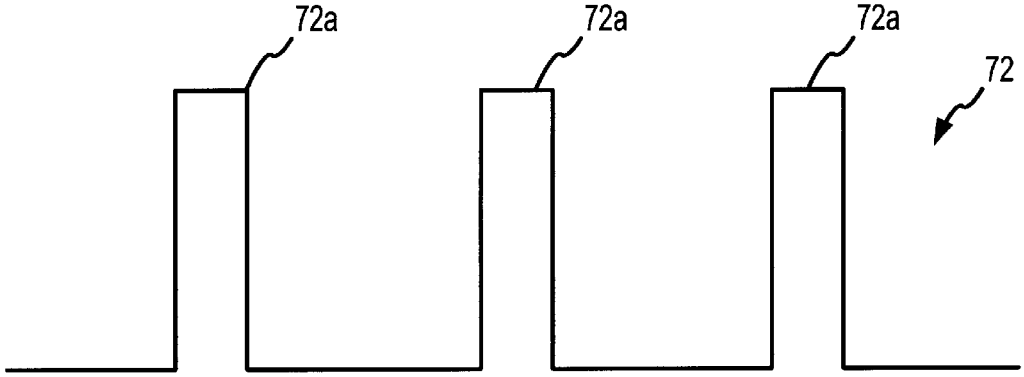
FIG. 4*c* illustrates an exemplary digital signal corresponding to the analog signal of FIG. 4*b;*

As the ball 12 rotates, the amplitude of the reflected radiation 36 is modulated each time the contrast area 60 comes into direct view of the transceiver 38 because the contrast area 60 provides different reflectivity to the transmitted radiation 34. Since the contrast area 60 preferably has higher reflectivity to the transmitted radiation 34, the amplitude of the reflected radiation 36 is preferably increased each time the contrast area 60 comes into view. Thus, the difference signal output by the transceiver 38 is also amplitude modulated and a difference signal 68 such as shown in FIG. 4*a* results. The portions 68*a* of the difference signal 68 having greater amplitude correspond to the times when the contrast area 60 is in direct view of the transceiver 38. When the difference signal 62 is demodulated, an analog signal 70, such as depicted in FIG. 4*b*, is obtained. The peaks 70*a* of the analog signal 70 correspond to the portions 68*a* of the difference signal 68 having greater amplitude as a result of the contrast area 60 coming into direct view of the transceiver 38. When the analog signal 70 is converted to a digital signal 72, a signal having a series of pulses 72*a* such as depicted in FIG. 4*c* results. The frequency of the pulses 72*a* provides information corresponding to the spin rate of the ball 12. Simply by computing the frequency of the pulses 72*a* of the digital signal 72 and converting such frequency to appropriate units, such as rpm, the spin rate of the ball 12 is determined.

Although only a single contrast area 60 is illustrated in FIG. 3, the present invention also contemplates the use of a plurality of contrast areas 60. For example, two or more contrast areas 60 may be symmetrically located on the surface of the ball 12 thereby increasing the number of pulses 72*a* generated while the transmitted radiation 34 intersects the flight path 20 of the ball 12. This is of particular advantage where the transceiver 38 is of relatively low power with a limited sensing range because a greater number of pulses 72*a* are obtained within the same portion of the ball's 12 flight path 20 than with only one contrast area 60. In such instances, the spin rate of the ball 12 is obtained by dividing the rate of the pulses 72*a* by the number of contrast areas 60.

Figure 5:
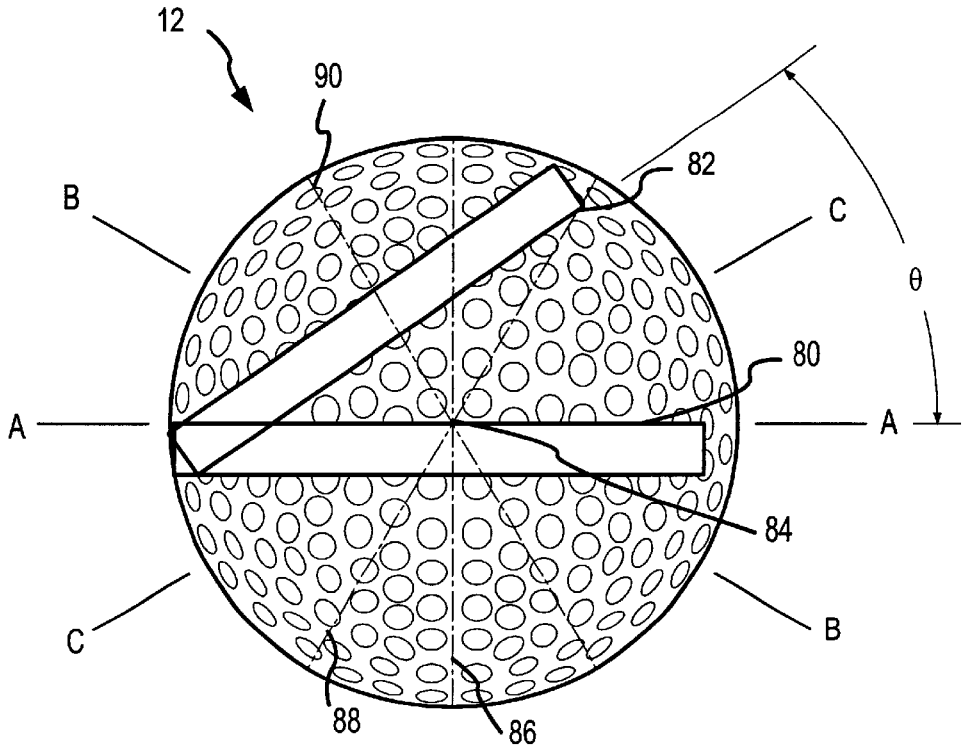
FIG. 5 illustrates another embodiment of a golf ball adapted for both spin rate and spin axis determination in accordance with the present invention.

Referring now to FIG. 5, one embodiment of a golf ball 12 adapted for both spin rate and spin axis determination using an apparatus 10 in accordance with the present invention is shown. The ball 12 includes two contrast areas 80, 82, which in this instance are on the surface of the ball 12. The contrast areas 80, 82 are comprised of a material, such as described above, providing different (preferably higher) reflectivity to the transmitted radiation 34 than the rest of the ball 12. The contrast areas 80, 82 are appropriately configured and arranged such that demodulated reflected radiation from the ball 12 includes pairs of periodic pulses wherein the interval between sequential pulse pairs varies in a manner corresponding to the spin axis of the ball 12. In this regard, the contrast areas 80, 82 are preferably rectangularly shaped and are arranged in a diverging, non-parallel fashion. Preferably, both of the contrast areas 80, 82 are located in the same hemisphere of the ball 12, overlap at one end thereof, but do not substantially cross each other. Also, when the hemisphere in which the contrast areas 80, 82 are located is depicted in two-dimensions as shown in FIG. 5, the contrast areas 80,82 preferably diverge from one another at angle θ that is acute. Before the ball is struck, it is preferably positioned with the long dimension of contrast area 80 parallel with the ground and contrast area 82 facing upwards as depicted in FIG. 5.

Figure 6:
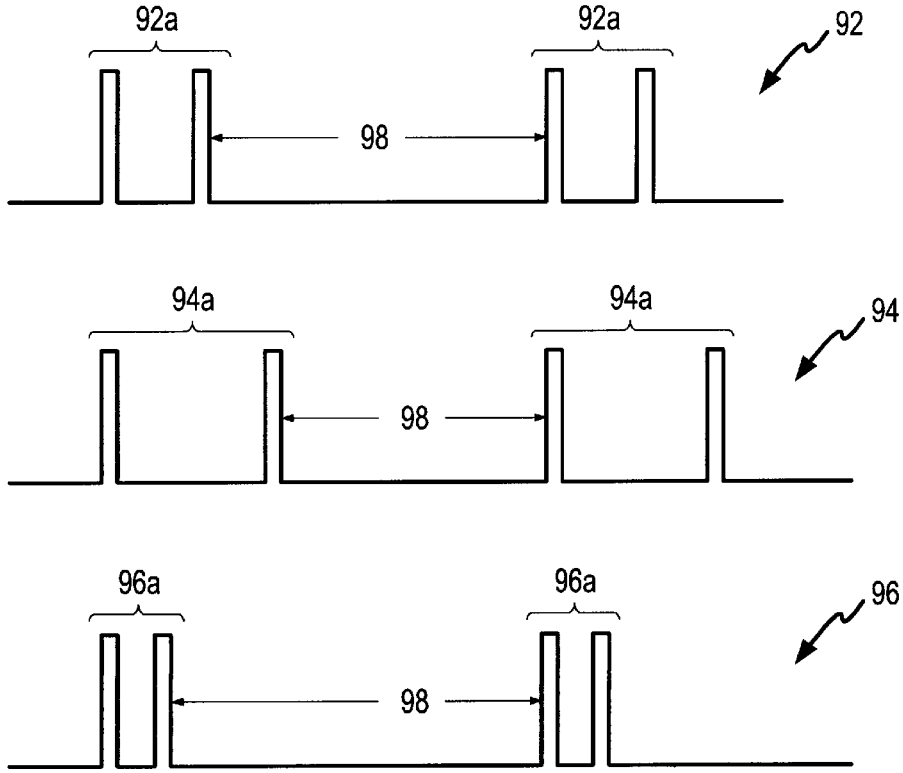
FIG. 6 illustrates exemplary digital signals obtained after demodulation and analog-to-digital conversion of a difference signal obtained from radiation reflected off a rotating golf ball such as the ball depicted in FIG. 5.

Depending upon how the ball 12 is struck, it may rotate in a number of fashions. Three such cases are shown wherein the ball 12 rotates about axis A—A (the perfect backspin case), or axes B—B and C—C (positive and negative sidespin cases, respectively) which deviate from the perfect backspin case. In the case of perfect backspin (i.e. ball 12 rotates about axis A—A), point 84 on the surface of the ball 12 traces a path indicated by dotted line 86 as the ball 12 rotates. In the cases of rotation about axes B—B or C—C, point 84 traces respective paths indicated by dotted lines 88, 90. As the ball 12 rotates, each contrast area 80, 82 sequentially passes into view of the transceiver 38 producing a pair of distinct increases in the amplitude of the reflected radiation 36. The resulting signal may be demodulated in the same manner as previously described for a ball 12 having a single contrast area 60 such as depicted in FIG. 3. The digital signal produced will have pairs of periodically repeating pulses. Such signals are depicted in FIG. 6, with digital signal 92 corresponding with spin about axis A—A, digital signal 94 corresponding with spin about axis B—B, and digital signal 94 corresponding with spin about axis C—C. Regardless of which axis about which the ball 12 is rotating, the overall repetition rate (i.e the frequency) of each pair of pulses 92*a*, 94*a*, 96*a* provides information about the spin rate of the ball. Computing means such as previously described may be used to analyze the frequency of the pulse pairs 92*a*, 94*a*, 96*a* for a given digital signal 92, 94, 96 to determine the spin rate of the ball 12.

In addition to determining spin rate, the spin axis may also be determined. The relative period of time separating pulse pairs 92*a*, 94*a*, 96*a* can be calibrated with a given geometry of contrast areas such that the spin axis can be determined. For example, in the case of positive sidespin (i.e. rotation about axis B—B) the interval 98 separating each pulse pair 94*a* of digital signal 94 is relatively shorter for a given spin rate in comparison to the interval 98 separating each pulse pair 92*a* of digital signal 92 generated in the perfect backspin case (i.e. rotation about axis A—A). As the positive sidespin increases, the relative separation of pulse pairs 94*a* compared to the total rotational period progressively shortens. In the case of negative sidespin (i.e. rotation about axis C—C), the interval 98 separating each pulse pair 96*a* of digital signal 96 is relatively longer for a given spin rate in comparison to the interval 98 separating each pulse pair 92*a* of digital signal 92 generated in the perfect backspin case. As the negative sidespin increases, the interval 98 between each pulse pair 94*a* compared to the total rotational period also increases.

For a given geometry of contrast areas 80, 82, such as depicted in FIG. 5, it is possible to define the relationship between the rotation axis and the ratio of the two arc lengths on the ball surface. Such relationship may be stored as a mathematical function in the computer 54, or, alternatively, may be stored in a look-up table. In all three cases, the spin rate of the ball 12 is determined from the major period between pulse pairs 92*a*, 94*a*, 96*a*. The ratio of the time interval 98 separating each pulse pair 92*a*, 94*a*, 96*a* to the total rotational period (i.e. the inverse of the spin rate) is also computed. The computed ratio provides a parameter correlated with the spin axis. Since the correlation is previously defined for a given geometry of contrast areas and stored as a mathematical function or as a look-up table, the spin axis of the ball 12 is determinable.

It will also be appreciated that in the case of positive sidespin the interval separating each pulse of a pulse pair 94*a* of digital signal 94 is relatively longer for a given spin rate in comparison to the interval separating each pulse of a pulse pair 92*a* of digital signal 92 obtained in the perfect backspin case (i.e. rotation about axis A—A). This is because the distance measured along the path 88 traced by point 84 between contrast areas 80, 82 is greater in the case of positive sidespin than the distance measured along the line 86 traced by point 84 in the case of perfect backspin. As the positive sidespin increases, the interval between each pulse of a pulse pair 94*a* increases. In the case of negative sidespin, the interval separating each pulse of a pulse pair 96*a* of digital signal 96 is relatively shorter for a given spin rate in comparison to the interval separating each pulse of a pulse pair 92*a* of digital signal 92 obtained in the perfect backspin case. This is because the distance measured along the path 90 traced by point 84 between contrast areas 80, 82 is shorter in the case of negative sidespin than the distance measured along the line 86 traced by point 84 in the case of perfect backspin. As the negative sidespin increases, the interval between each pulse of a pulse pair 94*a* decreases. Such information may also be used in determining the spin axis of the ball 12.

Figure 7:
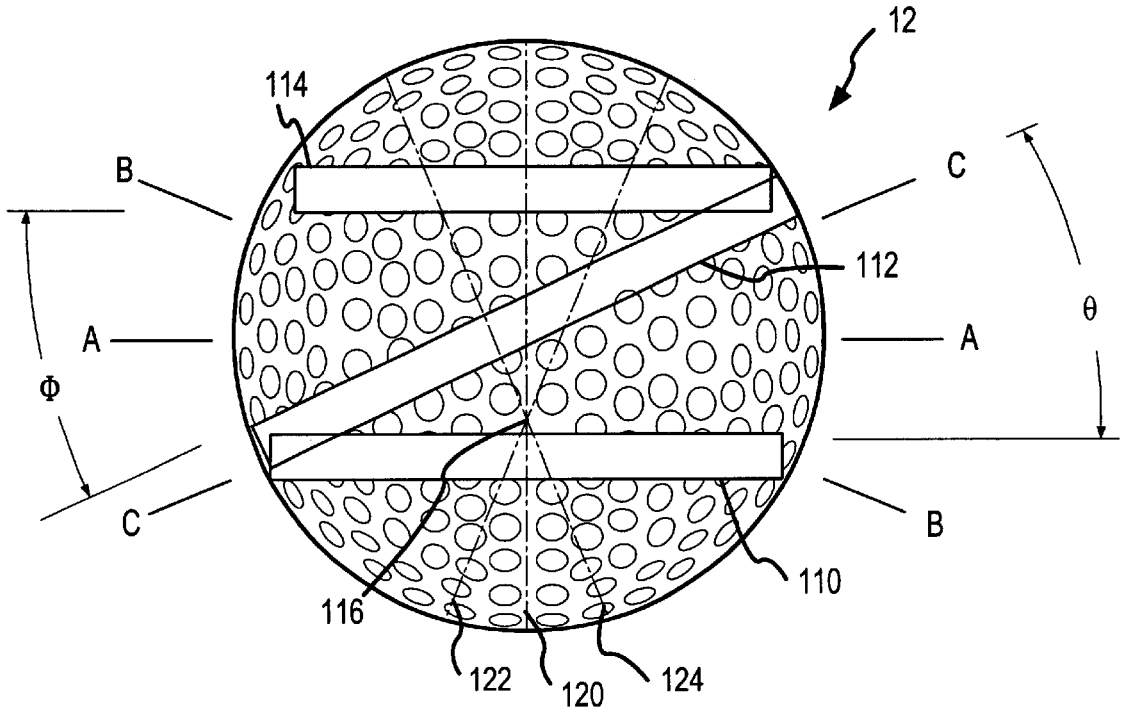
FIG. 7 illustrates an additional embodiment of a golf ball adapted for both spin rate and spin axis determination in accordance with the present invention.

Referring now to FIG. 7, another embodiment of a golf ball 12 adapted for both spin rate and spin axis determination using an apparatus 10 in accordance with the present invention is shown. The ball 12 includes three contrast areas 110, 112, 114 which in this instance are on the surface of the ball 12. The contrast areas 110, 112, 114 are comprised of a material, such as described above, providing different (preferably higher) reflectivity to the transmitted radiation 34 than the rest of the ball 12. The contrast areas 110, 112, 114 are arranged such that demodulated reflected radiation from the ball 12 includes groups of three pulses wherein the ratio of the two intervals between the three pulses in each group varies in a manner corresponding to the spin axis of the ball 12. Preferably, the three contrast areas 110, 112, 114 are located in the same hemisphere of the ball 12, are rectangularly shaped, and are arranged in a geometry approximating the letter "Z". Preferably, when the hemisphere in which the three contrast areas 110, 112, 114 are located is depicted in two dimensions as shown in FIG. 7, an angle $\theta$ measured between contrast areas 110 and 112 is acute and an angle $\phi$ measured between contrast areas 112 and 114 approximately equals $\theta$. Before the ball is struck, it is preferably positioned with the long dimension of contrast areas 110 and 114 parallel with the ground and contrast area 112 angling upwards from left to right as depicted in FIG. 5.

Figure 8:
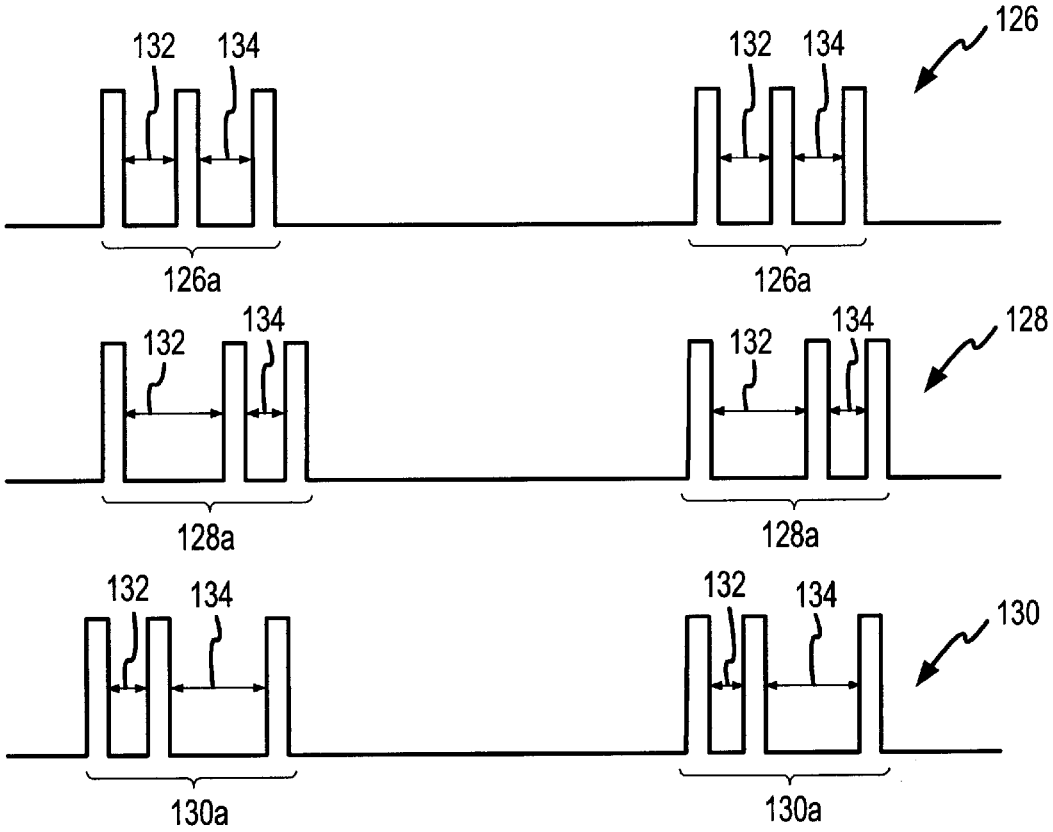
FIG. 8 illustrates exemplary digital signals obtained after demodulation and analog-to-digital conversion of a difference signal obtained from radiation reflected off a rotating golf ball such as the ball depicted in FIG. 7.

Depending upon how the ball 12 is struck, it may rotate in a number of fashions. Three such cases are shown wherein the ball 12 rotates about axis A—A (the perfect backspin case), axis B—B (positive sidespin case) or axis C—C (negative sidespin case). In the case of perfect backspin, point 116 on the surface of the ball 12 traces a path indicated by dotted line 120 as the ball 12 rotates. In the case of positive sidespin, point 116 traces a path indicated by dotted line 122. In the case of negative sidespin, point 116 traces a path indicated by dotted line 124. As the ball 12 rotates, each contrast area 110, 112, 114 sequentially passes into view of the transceiver 38 producing a group of three closely-spaced distinct increases in the amplitude of the reflected radiation 36. The resulting signal may be demodulated in the same manner as previously described for a ball 12 having a single contrast area 60 such as depicted in FIG. 3. The digital signal produced will have groups of three periodically repeating closely-spaced pulses. Such signals are depicted in FIG. 8, with digital signal 126 corresponding with the perfect backspin case, digital signal 128 corresponding with the positive sidespin case, and digital signal 130 corresponding with negative sidespin case. Regardless of which axis about which the ball 12 is rotating, the repetition period (i.e the frequency) of each group of pulses 126*a*, 128*a*, 130*a* provides information about the spin rate of the ball. Computing means such as previously described may be used to analyze the frequency of the pulse groups 126*a*, 128*a*, 130*a* for a given digital signal 126, 128, 130 to determine the spin rate of the ball 12.

Spin axis determination is possible based upon the ratio of the two time intervals 132, 134 separating the pulses of each group 126*a*, 128*a*, 130*a*. In the case of perfect backspin, the three pulses in each pulse group 126*a* are evenly spaced and the ratio of the interval 132 between the first and second pulses and the interval 134 between the second and third pulses is approximately 1. In the case of positive sidespin, the interval 132 between the first and second pulses of each pulse group 128*a* is larger than the interval 134 between the second and third pulses. As the positive sidespin component increases, the ratio of interval 132 over 134 increases. In the case of negative sidespin, the interval 132 between the first and second pulses of each pulse group 130*a* is smaller than the interval 134 between the second and third pulses. As the negative sidespin component increases, the ratio of interval 132 over 134 becomes smaller.

For a given geometry of contrast areas 110, 112, 114, such as depicted in FIG. 7, it is possible to define the relationship between the rotation axis and the ratio of the two intervals 132, 134 between the first and second and second and third pulses of a pulse group. Such relationship may be stored as a mathematical function in the computer 54, or, alternatively, may be stored in a look-up table. In all three cases, the spin rate of the ball 12 is determined from the major period between pulse groups 126*a*, 128*a*, 130*a*. The relative ratio of the time intervals 132, 134 provides a parameter correlated in a known, ratiometric manner with the axis of rotation. Since the correlation is previously defined for the given geometry of contrast areas utilized and stored as a mathematical function or as a look-up table, the spin axis of the ball 12 is thereby determinable.

Since, the contrast areas such as described above are on the surface of the ball 12, they may be understood to comprise a marking applied on the ball's 12 surface. Thus, the present invention may be practiced with a conventional ball 12 on which an appropriately configured marking has been applied. However, it is important to note that the contrast areas need not be on the surface of the ball 12. The ball 12 may be specially manufactured with a layer of an appropriate material providing one or more contrast areas located beneath surface of the ball 12. It is of importance however, that the material provide different reflectivity to the transmitted radiation 34 in a radially asymmetric fashion (i.e. the contrast area may not underlie the entire surface of the ball 12) so that as the ball rotates the reflected radiation 36 is amplitude modulated.

Figure 9A:
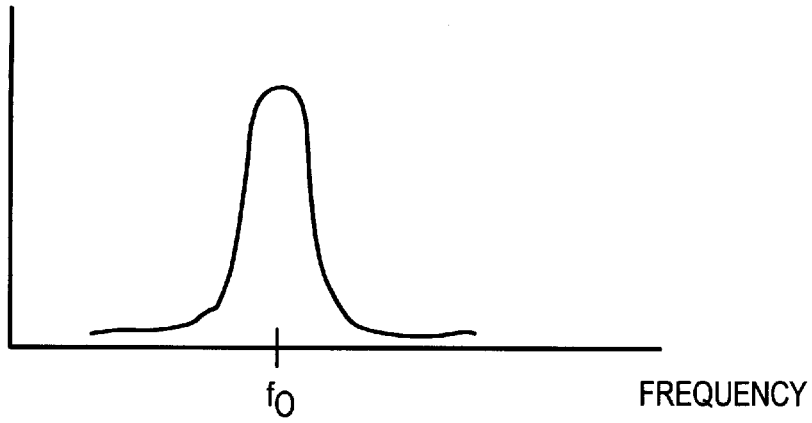
FIG. 9*a* illustrates the frequency spectrum of an exemplary difference signal obtained from radiation reflected off of a moving object such as a golf ball.
Figure 9B:
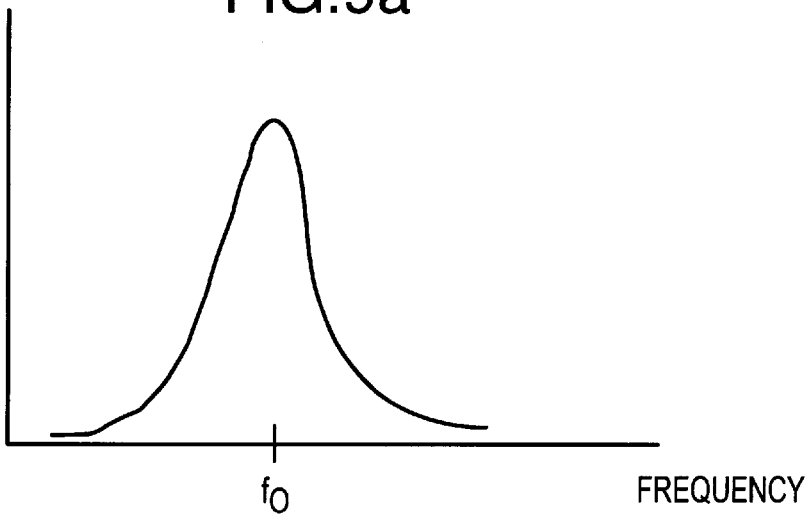
FIG. 9*b* illustrates Doppler broadening of the frequency spectrum shown in FIG. 9*a* resulting from the dimple pattern of the golf ball as it rotates.

The spin rate of a rotating object such as the golf ball 12 not having contrast areas as described above may also be determined by an apparatus 10 similar to the one described above. As the ball 12 rotates, its surface characteristics, namely the dimple pattern, acts to broaden the bandwidth of the reflected radiation 36 in known manner as a function of the spin rate of the ball 12. This condition, known as Doppler broadening is illustrated by comparing FIGS. 9*a* and 9*b*. FIG. 9*a* depicts an exemplary frequency spectrum of a difference signal obtained by mixing a portion of the transmitted radiation 34 with the received reflected radiation 34 that has been Doppler-shifted due to the velocity of the ball 12. The frequency spectrum is centered around the frequency $f_O$ corresponding to the velocity of the ball 12. FIG. 9*b* illustrates the frequency spectrum of same difference signal exhibiting Doppler broadening due to the rotation of ball 12 in conjunction with its surface roughness. As can be seen, the frequency spectrum is still centered around $f_O$, but the width of the spectrum has been broadened. Appropriate means may be included in the apparatus 10 for detecting such broadening and the computer 54 may be programmed for correlating the detected broadening with the spin rate of the ball 12.

Figure 9C:
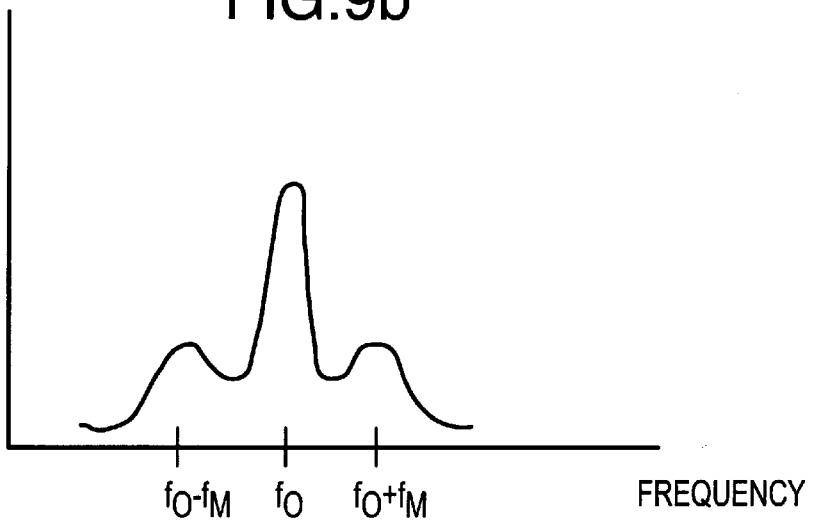
FIG. 9*c* illustrates the effect of asymmetry of the ball due to deformation caused by the impact of the golf club on the frequency spectrum shown in FIG. 9*b*.

Asymmetry caused by deformation of the ball 12 due to the high energy impact of the golf club 14 also causes another type of modulation in the reflected radiation 36 that may be utilized for determining the spin rate of the ball 12. When the face of the golf club 14 strikes the ball 12, the ball 12 compresses or flattens at the point of impact. Therefore, as the ball 12 rotates it presents a surface that periodically advances and recedes with respect to the ball's axis of rotation. Such asymmetry produces both frequency and amplitude modulation of the reflected Doppler-shifted radiation 36, occurring at the spin frequency of the ball. The frequency spectrum of an exemplary frequency and amplitude modulated difference signal obtained therefrom is depicted in FIG. 9*c*. Appropriate means may be included in the apparatus 10 to demodulate the resulting frequency and amplitude modulated difference signal output by the transceiver 38 so as to extract information corresponding to the spin rate of the ball from the frequency and amplitude modulation characteristics of the difference signal.

As will be appreciated by those with skill in the art, the alternative embodiments described above present the advantage of the ability to determine spin rates from an unmarked, or otherwise unmodified ball.

While various embodiments of the present invention have been described in detail, it is apparent that further modifications and adaptations of the invention will occur to those skilled in the art. However, it is expressly understood that such modifications and adaptations are within the spirit and scope of the present invention.

What is claimed is:

1. An apparatus for use in determining spin characteristics of a rotating object, said apparatus comprising:

a transmitter positionable for transmitting electromagnetic radiation of at least a first frequency at an object configured for reflecting at least a portion of said transmitted radiation in a modulated manner wherein said reflected radiation includes modulation characteristics from which at least a spin axis of the object is determinable;

a receiver positionable for receiving at least a portion of said reflected radiation; and a demodulator for detecting the modulation characteristics of said reflected radiation received by said receiver and outputting a demodulated signal including information about at least the spin axis of the object.

2. The apparatus of claim 1 wherein said transmitted radiation is in a radar frequency range.

3. The apparatus of claim 1 wherein said transmitted radiation is in a near infra-red frequency range.

4. The apparatus of claim 1 wherein the modulation characteristics of said reflected radiation comprise at least one of amplitude, frequency and phase modulation.

5. The apparatus of claim 1 wherein said transmitter and said receiver comprise a transceiver unit.

6. The apparatus of claim 5 wherein the object is moving relative to said transceiver and said reflected radiation exhibits a Doppler shift, said Doppler-shifted reflected radiation being mixed in said transceiver with a signal at the same frequency as said transmitted radiation to generate a difference signal having a frequency spectrum centered around a frequency corresponding to the velocity of the object and including modulation characteristics corresponding to the modulation characteristics of said reflected radiation.

7. The apparatus of claim 6 further comprising:

a pre-amplifier/filter; and a comparator;

and wherein:

said pre-amplifier/filter receives said difference signal from said transceiver and both amplifies and filters said difference signal;

said demodulator detects said modulation characteristics of said amplified and filtered difference signal and outputs a demodulated analog signal including information about at least one spin characteristic of the object; and said comparator converts said demodulated analog signal to a digital signal including information about at least one spin characteristic of the object.

8. The apparatus of claim 7 further comprising:

automatic gain control circuitry for further amplification of said difference signal prior to detection by said demodulator.

9. The apparatus of claim 7 wherein:

the object includes at least one contrast area having higher reflectivity to said transmitted radiation than the rest of the object;

said reflected radiation is amplitude modulated as a result of said at least one contrast area coming into view of said transceiver as the object rotates; and said demodulator is an AM demodulator having envelope detection circuitry.

10. The apparatus of claim 7 further comprising:

signal processing means for processing said digital signal to determine at least one spin characteristic of the object from said information included in said digital signal; and a display for displaying said determined spin characteristic.

11. The apparatus of claim 7 wherein the apparatus is interfaceable with a computer programmed for processing said digital signal to determine at least one spin characteristic of the object from said information included in said digital signal and displaying said determined spin characteristic.

12. The apparatus of claim 6 wherein said Doppler shifted reflected radiation exhibits Doppler broadening of a bandwidth of said frequency spectrum around said center Doppler frequency as a result of surface characteristics of the object, said Doppler broadening corresponding to a rate of spin of the object.

13. The apparatus of claim 12 wherein the object is a golf ball and said Doppler broadening results from a dimple pattern on the surface of the golf ball.

14. The apparatus of claim 6 wherein asymmetry of the object produces both frequency and amplitude modulation of the said Doppler shifted reflected radiation, said frequency and amplitude modulation of said Doppler shifted reflected radiation corresponding to a rate of spin of the object.

15. The apparatus of claim 14 wherein the object is a golf ball and said asymmetry results from deformation of the golf ball due to impact from a golf club.

16. An apparatus for use in determining spin characteristics of a golf ball moving over an expected flight path, said apparatus comprising:

a transceiver positionable for transmitting electromagnetic radiation of at least a first frequency into an expected flight path of a ball configured for reflecting at least a portion of said transmitted radiation in a modulated manner wherein said reflected radiation includes modulation characteristics from which at least a spin axis of the ball is determinable;

a portion of said reflected radiation being receivable by said transceiver and mixed therein with a signal at the same frequency as said transmitted radiation to generate a difference signal including modulation characteristics corresponding with the modulation characteristics of said reflected radiation;

a pre-amplifier/filter for receiving said difference signal from said transceiver and both amplifying and filtering said difference signal;

a detector for detecting said modulation characteristics of said amplified and filtered difference signal and outputting a demodulated analog signal including information about at least the spin axis of the ball; and a comparator for converting said demodulated analog signal to a digital signal including information about at least the spin axis of the ball.

17. The apparatus of claim 16 further comprising:

automatic gain control circuitry for further amplification of said difference signal prior to detection by said detector.

18. The apparatus of claim 16 wherein:

said reflected radiation is amplitude modulated in a manner such that a spin rate of the ball is determinable.

19. The apparatus of claim 16 wherein:

said reflected radiation is amplitude modulated in a manner such that a spin rate and the spin axis of the ball is determinable.

20. A ball adapted for determination of its spin characteristics, comprising:

at least one contrast area comprised of a material having different reflectivity than the rest of the ball to electromagnetic radiation of a predetermined frequency, said contrast area being configured for causing reflected radiation of the predetermined frequency reflected from the ball to be modulated in a manner from which at least a spin axis of the ball is determinable.

21. The ball of claim 20 wherein said contrast area comprises a marking applied on a surface of the ball.

22. The ball of claim 20 wherein said contrast area is beneath a surface of the ball.

23. The ball of claim 20 wherein said predetermined frequency to which said contrast area has different reflectivity is in at least one of a radar frequency range and a near infra-red frequency range.

24. The ball of claim 20 wherein said predetermined frequency to which said contrast area has different reflectivity is in at least one of an X, a K and a Ka frequency band.

25. The ball of claim 20 wherein said contrast area is configured for causing at least one of amplitude, frequency and phase modulation of radiation of said predetermined frequency reflected from said ball as the ball rotates.

26. The ball of claim 20 wherein said contrast area causes said reflected radiation to have periodic amplitude peaks occurring at a frequency corresponding to a spin rate of the ball.

27. The ball of claim 26 wherein said contrast area is rectangular in shape and has greater reflectivity than the rest of the ball to radiation of said predetermined frequency.

28. The ball of claim 20 wherein said contrast area includes two strips of greater reflectivity than the rest of the ball to radiation of said predetermined frequency, said two strips being arranged in a divergent, non-parallel fashion.

29. A ball adapted for determination of its spin characteristics, comprising:

two contrast areas comprised of a material having different reflectivity than the rest of the ball to electromagnetic radiation of a predetermined frequency, wherein said two contrast areas are configured for causing radiation of said predetermined frequency reflected from the ball as it rotates to have periodic pairs of amplitude peaks, said pairs occurring at a frequency corresponding to a spin rate of the ball, and wherein said two contrast areas are arranged such that an interval between sequential pairs of amplitude peaks varies in a known manner as a spin axis of the ball changes.

30. The ball of claim 29 wherein said two contrast areas are generally rectangular in shape, are located in a single hemisphere of the ball, and are arranged in a divergent, non-parallel fashion.

31. The ball of claim 30 wherein, when said hemisphere in which said contrast areas are located is depicted in two-dimensions, an angle measured between said two contrast areas that is acute.

32. The ball of claim 20 wherein said contrast area includes three strips of greater reflectivity than the rest of the ball to radiation of said predetermined frequency, said three strips being arranged in a manner resembling a letter "Z".

33. A ball adapted for determination of its spin characteristics, comprising:

three contrast areas comprised of a material having different reflectivity than the rest of the ball to electromagnetic radiation of a predetermined frequency, wherein said three contrast areas are configured for causing radiation of said predetermined frequency reflected from the ball as it rotates to have groups of three amplitude peaks, said groups occurring at a frequency corresponding to a spin rate of the ball, and wherein said three contrast areas are arranged such that a ratio of an interval between a first and a second amplitude peak in a group to an interval between said second and a third amplitude peak in the same group varies in a known manner as a spin axis of the ball varies.

34. The ball of claim 33 wherein said three contrast areas are generally rectangular shaped, are located in a single hemisphere of the ball, and are arranged in a manner resembling a letter "Z".

35. The ball of claim 34 wherein, when said hemisphere in which said contrast areas are located is depicted in two-dimensions, a first angle measured between a first and a second of said contrast areas is acute and a second angle measured between said second and a third of said contrast areas is substantially equal to said first angle.

36. A method of determining spin characteristics of a rotating object, said method comprising the steps of:

providing an object including at least one contrast area having different reflectivity than the rest of the object to electromagnetic radiation of a predetermined frequency and being configured for causing radiation of the predetermined frequency reflected from the object to be modulated in a manner from which a spin axis of the object is determinable;

transmitting electromagnetic radiation of the predetermined frequency in the direction of the object, a portion of the transmitted radiation being reflected from the object and amplitude modulated in a manner corresponding to at least one spin characteristic of the object as a result of the contrast area periodically facing a source of the transmitted radiation as the object rotates;

receiving a portion of the amplitude modulated reflected radiation; and demodulating the reflected radiation to generate a demodulated signal including information corresponding to at least a spin axis of the object.

37. The method of claim 36 wherein in said step of providing, the contrast area is a marking applied on a surface of the object.

38. The method of claim 36 wherein the demodulated signal includes periodic pulses and a spin rate of the object is determinable from a frequency of the pulses.

39. A method of determining spin characteristics of a rotating object, said method comprising the steps of:

providing an object including at least one contrast area having different reflectivity than the rest of the object to electromagnetic radiation of a predetermined frequency;

transmitting electromagnetic radiation of the predetermined frequency in the direction of the object, a portion of the transmitted radiation being reflected from the object and amplitude modulated in a manner corresponding to at least one spin characteristic of the object as a result of the contrast area periodically facing a source of the transmitted radiation as the object rotates;

receiving a portion of the amplitude modulated reflected radiation; and demodulating the reflected radiation to generate a demodulated signal including information corresponding to at least one spin characteristic of the object, wherein the demodulated signal includes periodic pairs of pulses, a spin rate of the object being determinable from a frequency of the pairs of pulses and a spin axis of the object being determinable from an interval between sequential pairs of pulses.

40. A method of determining spin characteristics of a rotating object, said method comprising the steps of:

providing an object including at least one contrast area having different reflectivity than the rest of the object to electromagnetic radiation of a predetermined frequency;

transmitting electromagnetic radiation of the predetermined frequency in the direction of the object, a portion of the transmitted radiation being reflected from the object and amplitude modulated in a manner corresponding to at least one spin characteristic of the object as a result of the contrast area periodically facing a source of the transmitted radiation as the object rotates;

receiving a portion of the amplitude modulated reflected radiation; and demodulating the reflected radiation to generate a demodulated signal including information corresponding to at least one spin characteristic of the object, wherein the demodulated signal includes periodic groups of three pulses, a spin rate of the object being determinable from a frequency of the groups of three pulses and a spin axis of the object being determinable from a ratio of an interval between a first and a second pulse of a group to an interval between the second and a third pulse of the same group.

* * * * *